US006835881B1

(12) United States Patent
Jackson

(10) Patent No.: US 6,835,881 B1
(45) Date of Patent: Dec. 28, 2004

(54) GUITAR PICK

(76) Inventor: Donald Jackson, 7802½ Maple Ave., Fontana, CA (US) 92336

( * ) Notice: Subject to any disclaimer, the term of this patent is extended or adjusted under 35 U.S.C. 154(b) by 0 days.

(21) Appl. No.: 10/388,724

(22) Filed: Mar. 17, 2003

(51) Int. Cl.[7] ..... G10D 3/16
(52) U.S. Cl. ..... 84/322; 84/320
(58) Field of Search ..... 84/322, 320, 321, 84/318

(56) References Cited

U.S. PATENT DOCUMENTS 4,137,814 A * 2/1979 Rowley ..... 84/322
5,905,217 A * 5/1999 Byers ..... 84/322
6,118,058 A * 9/2000 Rowley ..... 84/320
6,127,613 A * 10/2000 Hansel ..... 84/332

* cited by examiner

*Primary Examiner*—Kimberly Lockett
(74) *Attorney, Agent, or Firm*—Goldstein Law Offices, P.C.

(57) ABSTRACT

A guitar pick having a key ring hole for selective attachment to a key ring, and also having a centrally-located disc constructed from non-slippery material, in order to prevent the pick from slipping from a user's fingers while the pick is being used to play a guitar. The key ring hole is lined on both the front and rear surfaces of the pick with a raised bushing, in order to prevent the key ring hole from cracking or splitting after repeated use. When not being used to play a guitar, the guitar pick may be stored upon the key ring, in order to prevent the pick from becoming misplaced.

7 Claims, 2 Drawing Sheets

GUITAR PICK

BACKGROUND OF THE INVENTION

1. Field of the Invention

The invention generally relates to a guitar pick, and in particular it relates to a guitar pick having a key ring hole for selective attachment to a key ring, and also having a central disc constructed from non-slippery material, in order to prevent the pick from slipping from a user's fingers while the pick is being used to play a guitar.

2. Description of the Related Art

Probably the most important accessory for a guitar player is a guitar pick, generally a triangular-shaped disc which is used for strumming or plucking the strings of a guitar. Guitar picks notoriously become lost. Either they slip from the musician's hands as he/she sweats, or they are simply misplaced. In any case, guitar players are constantly searching for a pick when they wish to play. A great variety of guitar picks have been devised, constructed of different materials and having different shapes.

For example, U.S. Pat. No. 4,228,719 to Keene appears to show a pick for a stringed musical instrument having holes of different sizes. However, the holes in Keene are provided so that the different edges of the pick have different flexibility, in order to produce different musical results.

Additionally, U.S. Pat. No. 4,993,302 to Jonathan appears to show a guitar pick coated with a non-hardening adhesive to reduce slipping from the fingers of a user. Furthermore, U.S. Pat. No. 4,137,814 to Rowley appears to show a guitar pick which is attached to a palm piece held in the palm of a user in order to prevent the pick from slipping from the fingers of the user.

None of these devices appears to show a guitar pick having a non-slippery central disc and also having a key ring hole for selective attachment to a key ring. While these units may be suitable for the particular purpose employed, or for general use, they would not be as suitable for the purposes of the present invention as disclosed hereafter.

SUMMARY OF THE INVENTION

It is an object of the invention to produce a guitar pick which is not easily misplaced after being used for playing a guitar. Accordingly, the guitar pick has a key ring hole for selective attachment to a key ring. After attachment to the key ring, the guitar pick may be carried in the pocket of a user, and it is not easily misplaced.

It is another object of the invention to produce a guitar pick having a key ring hole which will not split or crack after repeatedly attaching and removing the guitar pick from the key ring. Accordingly, the key ring hole is reinforced with a metal or plastic bushing, in order to prevent the key ring hole from splitting or cracking after repeatedly attaching and removing the pick from the key ring.

It is a further object of the invention to produce a guitar pick which will not easily slip from the fingers of the user while being used to play a guitar. Accordingly, the pick has a centrally located circular disc which is constructed from non-slippery material, thereby preventing the pick from slipping from the fingers of the user while using the pick to play the guitar.

The invention is a guitar pick having a key ring hole for selective attachment to a key ring, and also having a centrally-located disc constructed from non-slippery material, in order to prevent the pick from slipping from a user's fingers while the pick is being used to play a guitar. The key ring hole is lined on both the front and rear surfaces of the pick with a raised bushing, in order to prevent the key ring hole from cracking or splitting after repeated use. When not being used to play a guitar, the guitar pick may be stored upon the key ring, in order to prevent the pick from becoming misplaced.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
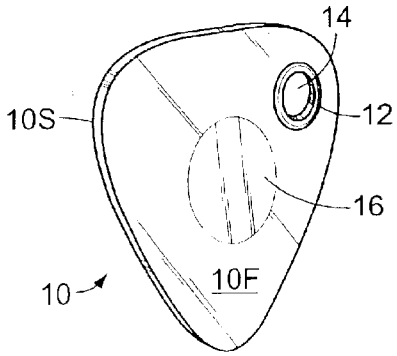
FIG. 1 is a perspective view of the guitar pick.

FIG. 1 illustrates a perspective view of the guitar pick 10. The guitar pick 10 comprises a thin, substantially triangular, flat piece of plastic having a front surface 10F and a rear surface, and has a key ring hole 14 extending fully from the front surface 10F to the rear surface. The key ring hole 14 is reinforced on both the front surface 10F and the rear surface with a raised, substantially circular bushing 12, which prevents the hole 14 from cracking or splitting after repeatedly attaching and removing the pick 10 from the key ring 18. The bushing 12 may be constructed from metal or plastic. The guitar pick 10 further has a centrally located, substantially circular disc 16 on its front surface 10F, which is constructed from a material that is non-slippery even when moist, for preventing the pick 10 from slipping from the fingers of a user while the pick 10 is being deployed for playing a guitar. The disc 16 may be constructed from metal or plastic.

Figure 2:
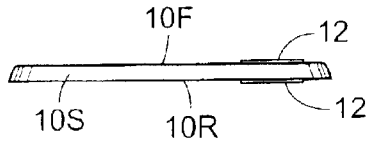
FIG. 2 is a side view of the guitar pick.

FIG. 2 illustrates a side view of the guitar pick 10. The pick 10 has a thin side wall 10S. The bushing 12 is seen to protrude slightly upward from both the front surface 10F and the rear surface 10R of the pick 10. The disc 16 is not seen in this side view, because it is substantially flush with the front surface 10F of the pick 10.

Figure 3:
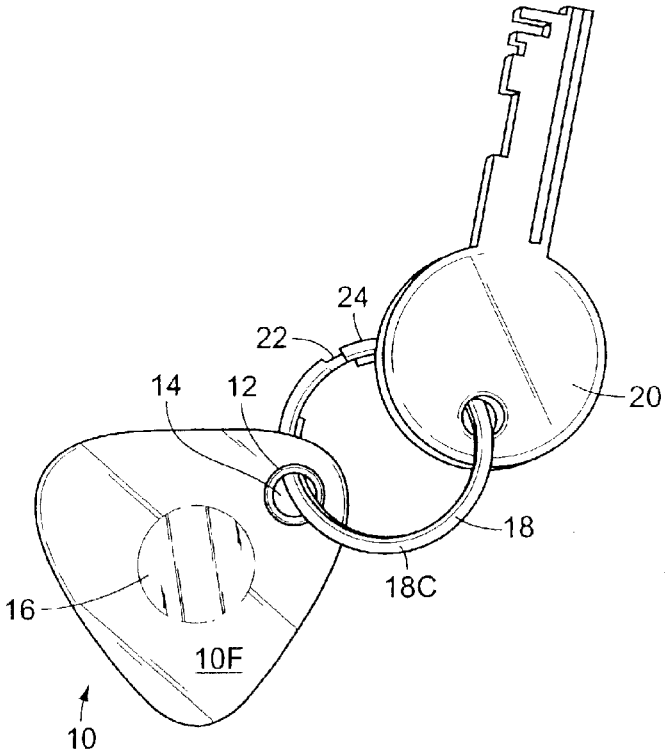
FIG. 3 is a perspective view of the guitar pick after selective attachment to a key ring.

FIG. 3 illustrates a perspective view of the guitar pick 10 after selective attachment to a key ring 18 having an attached key 20. The key ring 18 has a circular loop 18C having a latch 22 and a latch slot 24. The key ring 18 is closed by fitting the latch 22 upon the latch slot 24, thereby forming the closed circular loop 18C for containment therein of the key 20 and the guitar pick 10. Obviously, the guitar pick 10 may be selectively attached to any number of different key rings, of various shapes and sizes, as long as the loop 18C which defines the functional portion of the key ring 18 is smaller in diameter then the diameter of the key ring hole 14 within the guitar pick 10.

Figure 4:
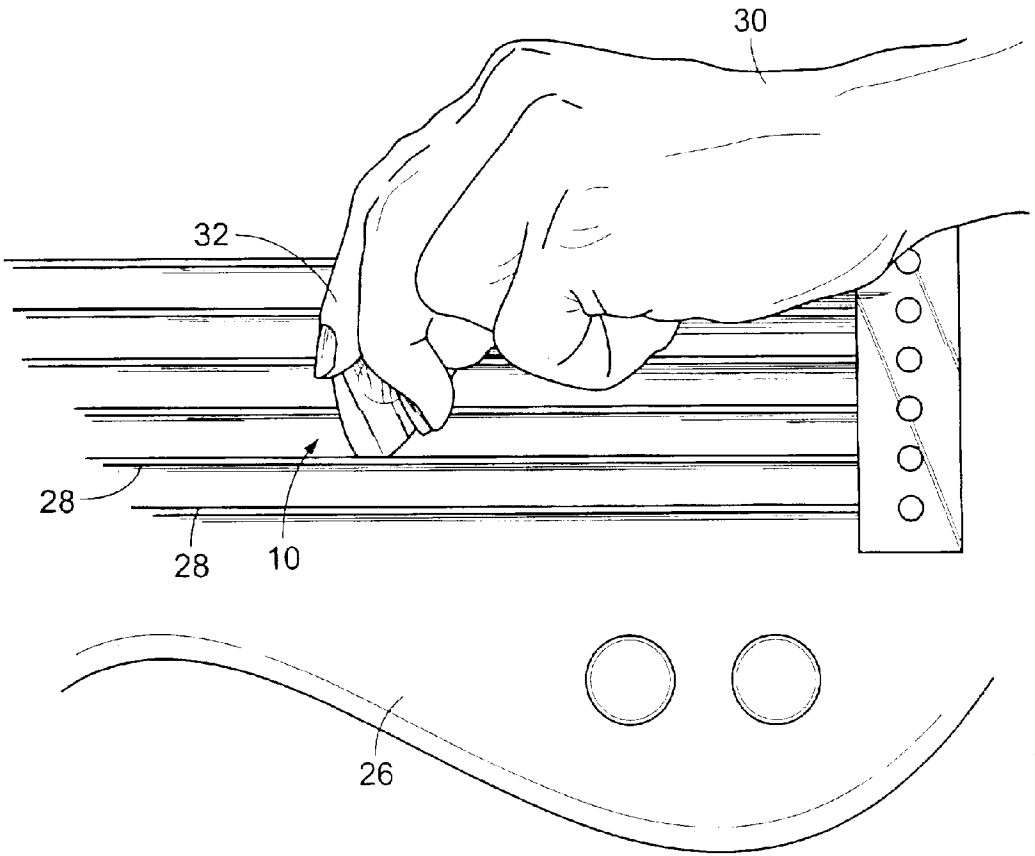
FIG. 4 is a perspective view of the guitar pick being deployed by a user to play a guitar.

FIG. 4 illustrates a perspective view of the guitar pick 10 being deployed by a user having a hand 30 having fingers 32, for playing a guitar 26 having a plurality of strings 28. The pick 10 is being held between the thumb and index fingers 32 of the user, and is used to pluck the strings 28 of the guitar 26, in order to produce sounds characteristic of the guitar 26.

In use, the pick 10 is easily attached to virtually any key ring or key chain which is suitable for storing a key having a hole extending therethrough. The guitar pick 10 is stored upon the key ring in an identical fashion as the key. In particular, the user simply extends the key ring 18 through the key ring hole 14 extending fully through the front 10F and rear surfaces of the guitar pick 10, thereby storing the pick 10 along with the other keys 20 on the key ring 18. Additionally, the user may attach the pick 10 to an empty key ring 18, and attach the key ring 18 to a belt loop or a purse strap. When the user wants to deploy the pick 10 for playing a guitar 26, the user removes the pick 10 from the key ring 18 in the same manner as he/she would remove a key 20 from the key ring 18. The user rests a thumb of the hand on the non-slippery disc 16 on the front surface 10F of the pick 10, while holding the pick 10 between the thumb and index finger. The user may then play the guitar 26 without having the pick 10 inadvertently slide from between the user's fingers. After use, the pick 10 is stored on the key ring 18 until again needed for playing the guitar 26.

In conclusion, herein is presented a guitar pick having a key ring hole for selective attachment to a key ring, and also having a central disc constructed from non-slippery material, for preventing the pick from slipping from a user's fingers while the pick is being used to play a guitar. The invention is illustrated by example in the drawing figures, and throughout the written description. It should be understood that numerous variations are possible, while adhering to the inventive concept. Such variations are contemplated as being a part of the present invention.

What is claimed is:

1. A guitar pick for playing a guitar, for use in conjunction with a key ring, said guitar pick comprising a thin, substantially flat piece of material having a front surface and a rear surface, further comprising a key ring hole extending fully from the front surface to the rear surface, for selectively storing the guitar pick upon the key ring when the guitar pick is not being used for playing a guitar.

2. The guitar pick as recited in claim 1, wherein the key ring hole is reinforced on both the front surface of the pick and the rear surface of the pick with a raised bushing, for preventing the key ring hole from cracking or splitting after repeated use.

3. The guitar pick as recited in claim 2, further comprising a substantially circular disc which is substantially centrally located on the front surface of the pick, said disc being constructed from a non-slippery material for preventing the pick from slipping from the fingers of a user while the pick is being deployed to play the guitar.

4. The guitar pick as recited in claim 3, wherein the key ring hole is substantially circular.

5. The guitar pick as recited in claim 4, wherein the bushing is substantially circular.

6. A method of using a guitar pick by a user having a hand having fingers, for playing a guitar having strings, said guitar pick having a thin, substantially flat piece of material having a front surface and a rear surface, further having a key ring hole extending fully from the front surface to the rear surface, comprising the steps of:

a) utilizing the pick to strum the strings of the guitar;

b) storing the pick upon the key ring when the pick is not being used for playing the guitar, by extending the key ring through the key ring hole;

c) storing the key ring by the user; and d) removing the pick from the key ring when the pick is once again needed for playing the guitar.

7. The method of using a guitar pick as recited in claim 6, wherein the pick further has a substantially centrally located, substantially circular disc located on the front surface of the pick, wherein said disc is constructed from a non-slippery material, wherein the step of utilizing the pick to play the guitar further comprises resting the thumb of the user on the disc while holding the pick between the thumb and index finger, and thereby preventing the pick from slipping from the fingers of the user while the pick is being deployed to play the guitar.

* * * * *